US008316654B2

(12) United States Patent
Heinbokel et al.

(10) Patent No.: US 8,316,654 B2
(45) Date of Patent: Nov. 27, 2012

(54) REFRIGERATING SYSTEM AND METHOD FOR REFRIGERATING

(75) Inventors: Bernd Heinbokel, Cologne (DE); Siegfried Haaf, Cologne (DE)

(73) Assignee: Carrier Corporation, Farmington, CT (US)

( * ) Notice: Subject to any disclaimer, the term of this patent is extended or adjusted under 35 U.S.C. 154(b) by 380 days.

(21) Appl. No.: 12/742,847

(22) PCT Filed: Nov. 13, 2007

(86) PCT No.: PCT/EP2007/009810

§ 371 (c)(1), (2), (4) Date: May 13, 2010

(87) PCT Pub. No.: WO2009/062526

PCT Pub. Date: May 22, 2009

(65) Prior Publication Data

US 2010/0281882 A1 Nov. 11, 2010

(51) Int. Cl.
*F25B 7/00* (2006.01)

(52) U.S. Cl. ..... 62/79; 62/498

(58) Field of Classification Search ..... 62/79, 498, 62/513, 115, 507, 510, 512, 509; 165/104.11, 165/104.13

See application file for complete search history.

(56) References Cited

U.S. PATENT DOCUMENTS 3,266,258 A 8/1966 Rosenfeld
4,005,949 A * 2/1977 Grant ..... 418/15
4,435,581 A * 3/1984 Miserlis ..... 549/248
4,538,418 A * 9/1985 Lawrence et al. ..... 62/79
5,333,677 A * 8/1994 Molivadas ..... 165/272
5,351,487 A * 10/1994 Abdelmalek ..... 60/618
5,477,697 A * 12/1995 Wharton et al. ..... 62/117
6,557,361 B1 5/2003 Howard
6,739,141 B1 5/2004 Sienel
2001/0027664 A1 * 10/2001 Ross ..... 62/513

(Continued)

FOREIGN PATENT DOCUMENTS

DE 19522884 A1 1/1997

(Continued)

OTHER PUBLICATIONS

International Search Report PCT/EP2007/009810; Dated Jul. 24, 2008.

*Primary Examiner* — Mohammad Ali
(74) *Attorney, Agent, or Firm* — Cantor Colburn LLP

(57) ABSTRACT

A Refrigerating system (2) comprises a refrigerating circuit (4) having, in flowing direction, a compressor (8), a gas cooler (10), a first expansion device (12), an intermediate pressure container (14), a second expansion device (16), an evaporator (18) and refrigerant conduits (22, 24, 26, 28, 30, 32) circulating a refrigerant therethrough. The first expansion device (12) expands the refrigerant to an intermediate pressure level. A first refrigerant conduit (22) of the refrigerant conduits (22, 24, 26, 28, 30, 32) connects the compressor (8) and the gas cooler (10), and a second refrigerant conduit (24) of the refrigerant conduits (22, 24, 26, 28, 30, 32) connects the gas cooler (10) and the first expansion device (12), the first refrigerant conduit (22), the gas cooler (10), and the second refrigerant conduit (24) forming a transcritical portion of the refrigerating circuit (4). The refrigerating system (2) further comprises a desuperheating unit (6), being in a heat exchange relationship with at least a part of the second refrigerant conduit (24), thereby desuperheating the refrigerant.

16 Claims, 2 Drawing Sheets

U.S. PATENT DOCUMENTS

| | | | | |
|---|---|---|---|---|
| 2005/0044865 | A1* | 3/2005 | Manole | 62/149 |
| 2005/0126194 | A1* | 6/2005 | Ebara et al. | 62/228.3 |
| 2005/0150240 | A1* | 7/2005 | Doi et al. | 62/225 |
| 2006/0117793 | A1* | 6/2006 | Tsugawa et al. | 62/527 |
| 2006/0277932 | A1* | 12/2006 | Otake et al. | 62/196.1 |
| 2007/0056312 | A1 | 3/2007 | Kobayashi | |
| 2007/0130770 | A1 | 6/2007 | Lee | |

FOREIGN PATENT DOCUMENTS

| | | | |
|---|---|---|---|
| EP | 1577622 | A2 | 9/2005 |
| EP | 1669697 | A1 | 6/2006 |
| EP | 1701112 | A1 | 9/2006 |
| EP | 1207359 | B1 | 1/2008 |
| EP | 1555493 | B1 | 3/2010 |
| JP | 200191074 | | 4/2001 |
| JP | 2001317820 | | 11/2001 |
| JP | 2002 130770 | | 5/2002 |
| JP | 2004190916 | | 7/2004 |
| JP | 2004190917 | | 7/2004 |
| JP | 200617350 | | 1/2006 |
| WO | 2008032558 | A1 | 3/2008 |

* cited by examiner

REFRIGERATING SYSTEM AND METHOD FOR REFRIGERATING

The invention relates to a refrigerating system and to a method for refrigerating.

Refrigerating systems comprising a refrigerating circuit are well known in the art. It is also known to operate the compressor of the refrigerating circuit in such a way that the refrigerant, e.g. $CO_2$, is in a transcritical state on the high pressure side of the compressor. In these systems, especially when operated at a commonly used pressure value of approximately 120 bar on the high pressure side of the compressor, it is difficult to achieve the desired cooling of the refrigerant. At high ambient temperatures, starting at 30° C., reaching the desired cooling causes low energy efficiency.

Accordingly, it would be beneficial to provide a more efficient refrigerating system, which can achieve the desired performance, even when ambient temperatures are high.

Exemplary embodiments of the invention include a refrigerating system comprising a refrigerating circuit having, in flowing direction, a compressor, a gas cooler, a first expansion device, an intermediate pressure container, a second expansion device, an evaporator and refrigerant conduits circulating a refrigerant therethrough, wherein the first expansion device expands the refrigerant to an intermediate pressure level. A first refrigerant conduit of the refrigerant conduits connects the compressor and the gas cooler, and a second refrigerant conduit of the refrigerant conduits connects the gas cooler and the first expansion device, the first and second refrigerant conduits forming a transcritical portion of the refrigerating circuit. The compressor is operable such that the refrigerant is in a transcritical state in the transcritical portion. The refrigerating system is characterized in that it further comprises a desuperheating unit, the desuperheating unit being in a heat exchange relationship with at least a part of the second refrigerant conduit, thereby in operation desuperheating the refrigerant being circulated in the refrigerating circuit.

Exemplary embodiments of the invention further include a method for refrigerating comprising the steps of compressing a refrigerant to a transcritical pressure level; cooling the refrigerant in a gas cooler; desuperheating the refrigerant via heat exchange with a desuperheating unit; expanding the refrigerant to an intermediate pressure level via a first expansion device; flowing the refrigerant into an intermediate pressure container; expanding the refrigerant further via a second expansion device; and flowing the refrigerant through an evaporator, thus cooling the environment of the evaporator.

Embodiments of the invention are described in greater detail below with reference to the Figures, wherein.

Figure 1:
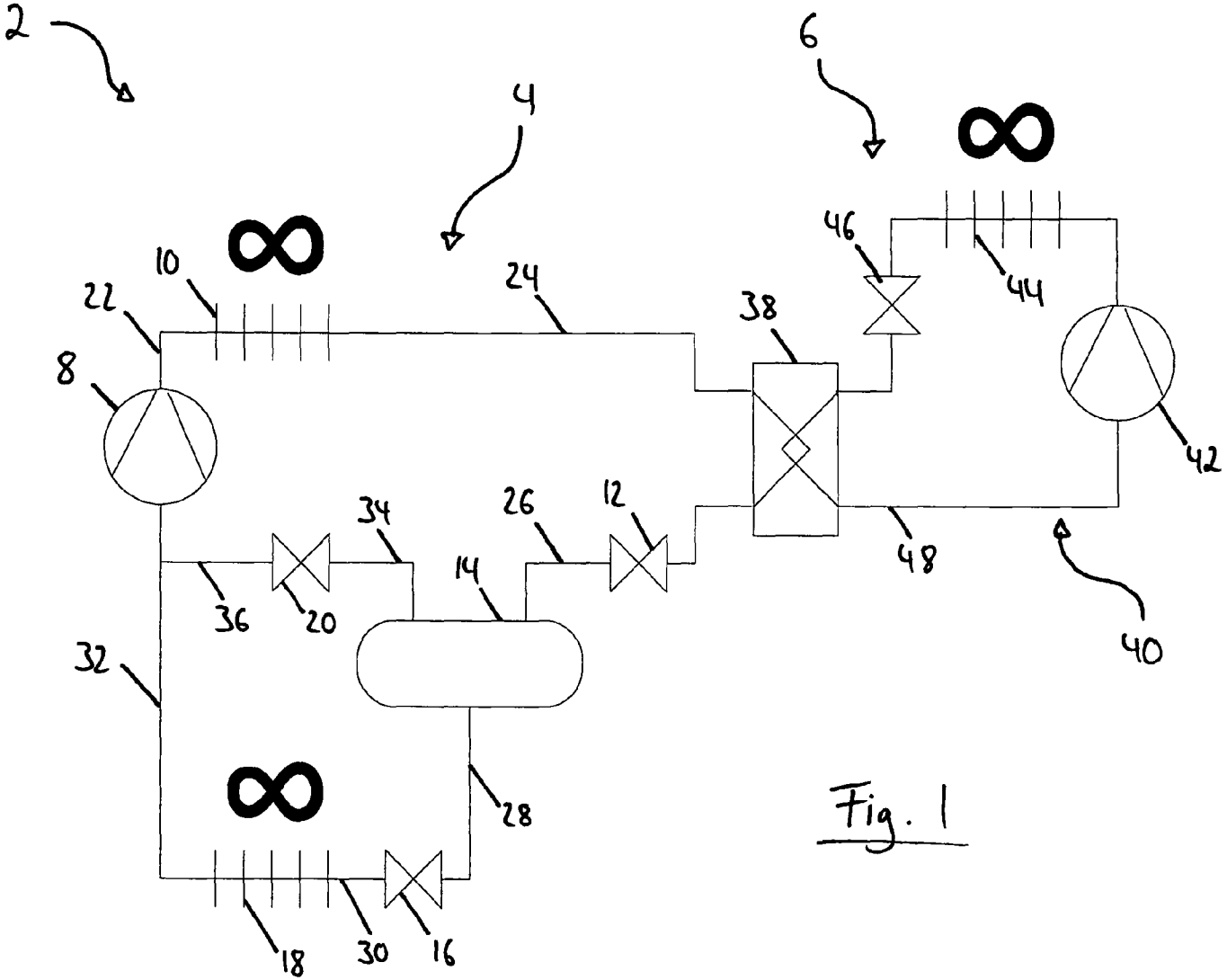
FIG. 1 shows a schematic of an exemplary refrigerating system in accordance with the present invention, wherein the desuperheating unit comprises a refrigerant circuit.

FIG. 1 shows a refrigerating system 2 in accordance with an embodiment of the present invention. The refrigerating system 2 comprises a refrigerating circuit 4 and a desuperheating unit 6. The refrigerating circuit 4 includes six components, commonly used in transcritically operated refrigerating circuits: A compressor 8, a gas cooler 10, a first expansion device 12, an intermediate pressure container 14, a second expansion device 16, and an evaporator 18. These elements are connected by refrigerant conduits, by which a refrigerant circulates through said elements. A first refrigerant conduit 22 connects the compressor 8 and the gas cooler 10, a second refrigerant conduit 24 connects the gas cooler 10 and the first expansion device 12, a third refrigerant conduit 26 connects the first expansion device 12 and the intermediate pressure container 14, a fourth refrigerant conduit 28 connects the intermediate pressure container 14 and the second expansion device 16, a fifth refrigerant conduit 30 connects the second expansion device 16 and the evaporator 18, and a sixth refrigerant conduit 32 connects the evaporator 18 and the compressor 8.

It is understood that the above described structure is exemplary and that modifications thereof are equally possible. Particularly, it is an option to have a plurality of components instead of a single component. E.g., a compressor 8 can be replaced by a set of compressors; there can also be a plurality of evaporators 18, each associated with a respective second expansion device 16. Also, by placing components in direct fluid connection with each other, individual conduits might be left out.

The refrigerating circuit 4 of FIG. 1 further comprises a refeed passage from the intermediate pressure container 14, particularly the gas space thereof, to the suction side of the compressor 8, which is optional for the refrigerating system of the present invention. The refeed passage comprises a third expansion device 20, a seventh refrigerant conduit 34 connecting the intermediate pressure container 14 and the third expansion device 20, and an eighth refrigerant conduit 36 connecting the third expansion device 20 and the compressor 8.

In the exemplary embodiment of FIG. 1, the desuperheating unit 6 comprises a desuperheating refrigerating circuit 40. The desuperheating refrigerant circuit 40 comprises, in flow direction, a compressor 42, a condensor 44, and an expansion device 46. Refrigerant conduits 48 connect said elements of the desuperheating refrigerating circuit and circulate a refrigerant therethrough.

A portion of the second refrigerant conduit 24 of the refrigerating circuit 4 is in heat exchange relationship with the desuperheating unit 6. The heat exchange is effected by a heat exchanger 38 coupling a portion of the second refrigerant conduit 24 of the refrigerating circuit 4 and a portion of the refrigerant conduit 48 of the desuperheating refrigerating circuit 40, which is disposed between the expansion device 46 and the compressor 42 of the desuperheating refrigerating circuit 40. It is apparent to a person skilled in the art that there are numerous ways to effect heat exchange between two elements. The term heat exchanger shall be used herein to include all these equivalent solutions.

It is also understood that the desuperheating unit 6 comprises a refrigerating circuit 40 only in the exemplary embodiment shown in FIG. 1. Different implementations adapted to provide desuperheating of the refrigerant in the refrigerating circuit 4 via heat exchange with at least a portion of the second refrigerant conduit 24 shall be within the scope of the invention.

The operation of the refrigerating system 2 according to the exemplary embodiment of FIG. 1 is explained as follows:

The compressor 8 is operated, such that the refrigerant, e.g. $CO_2$, enters the first refrigerant conduit 22 in a transcritical state. When $CO_2$ is used, a typical pressure value on the high pressure side of the compressor is up to 120 bar. The refrigerant is then cooled in the gas cooler 10. The lower limit of the temperature that the refrigerant leaves the gas cooler with is dependent on the ambient temperature. Consequently, the refrigerant enters the second refrigerant conduit 24 at a temperature higher than the ambient temperature of the gas cooler 10.

The gas cooler 10 can have various embodiments. In one embodiment, air may be blown over the structure of the gas cooler 10 by fans, carrying away the heat from the refrigerating circuit 4. The air may be enriched with water particles, increasing the heat capacity of the fluid blown over the gas cooler 10. Systems based on water cooling can also be thought of. Further embodiments will be apparent to a person skilled in the art.

In a portion of the second refrigerant conduit 24 the refrigerant is desuperheated, i.e. the temperature of the refrigerant being in a transcritical state is decreased, via heat exchange with the desuperheating unit 6. For that purpose a portion of the second refrigerant conduit 24 is disposed in the heat exchanger 38.

The refrigerant is flown through the first expansion device 12, which expands the refrigerant from a transcritical to an intermediate pressure level. The refrigerant reaches intermediate pressure container 14 through third refrigerant conduit 26. The intermediate pressure container 14 collects refrigerant at the intermediate pressure level and—as an optional feature implemented in the present embodiment—separates liquid refrigerant from gaseous refrigerant. The liquid phase refrigerant is flown through the fourth refrigerant conduit 28, the second expansion device 16, and the fifth refrigerant conduit 30, in order to reach the evaporator 18—after the second expansion—at a temperature that is the lowest the refrigerant will reach in the refrigerating circuit 4. This allows for cooling the environment of the evaporator 18. After said heat exchange the refrigerant is flown back to the compressor 8 via the sixth refrigerant conduit 32. Gaseous phase refrigerant is fed back from the intermediate pressure container 14 to the compressor 8 via the seventh refrigerant conduit 34, the third expansion device 20, and the eighth refrigerant conduit 36, as it can not be used as efficiently for cooling as the liquid phase refrigerant.

In the exemplary embodiment of FIG. 1, a refrigerant out of the group consisting of Propane, Propene, Butane, R410A, R404A, R134a, NH3, DP1, and Fluid H is flown through the desuperheating refrigerant circuit 40 of the desuperheating unit 6. As Propane and Propene are natural gases, whereas the other options are synthetic gases, their use may be preferred in many embodiments. It is apparent to a person skilled in the art that there are further options for refrigerants used in the desuperheating refrigerating circuit 40.

The refrigerant of the desuperheating refrigerating circuit 40 is compressed by the compressor 42. In the embodiment shown in FIG. 1, the refrigerant does not reach a transcritical state. The refrigerant is in the gaseous phase between the heat exchanger 38 and the compressor 42 as well as between the compressor 42 and the condenser 44. After the condenser 44 and until the heat exchanger 38, it is in the liquid phase. The refrigerant is flown through the condenser 44 and the expansion device 46, so that it leaves expansion device 46 in a cooled state and is capable of having heat transferred to it.

The refrigerant of the desuperheating refrigerating circuit 40 is then flown through the heat exchanger 38, where heat exchange between said refrigerant and the refrigerant circulating through refrigerating circuit 4 takes place. As the refrigerant of the refrigerating circuit 4 is at a higher temperature in the second refrigerant conduit 24 than the refrigerant of the desuperheating refrigerant circuit 40, when flowing through heat exchanger 38, heat is transferred from the refrigerant of the refrigerating circuit 4 to the refrigerant of the desuperheating refrigerating circuit 40. I.e. the heat capacity of the refrigerant of the desuperheating refrigerating circuit 40 is used in the heat exchanger 38 before it is flown back to the compressor 42 of the desuperheating refrigerant circuit 40.

In FIG. 1, the heat exchanger 38 is shown in a concurrent flow. The heat exchanger could also be connected in a way to have counter current flow or others. Counter current flow is normally more efficient, which could therefore be the preferred choice.

Figure 2:
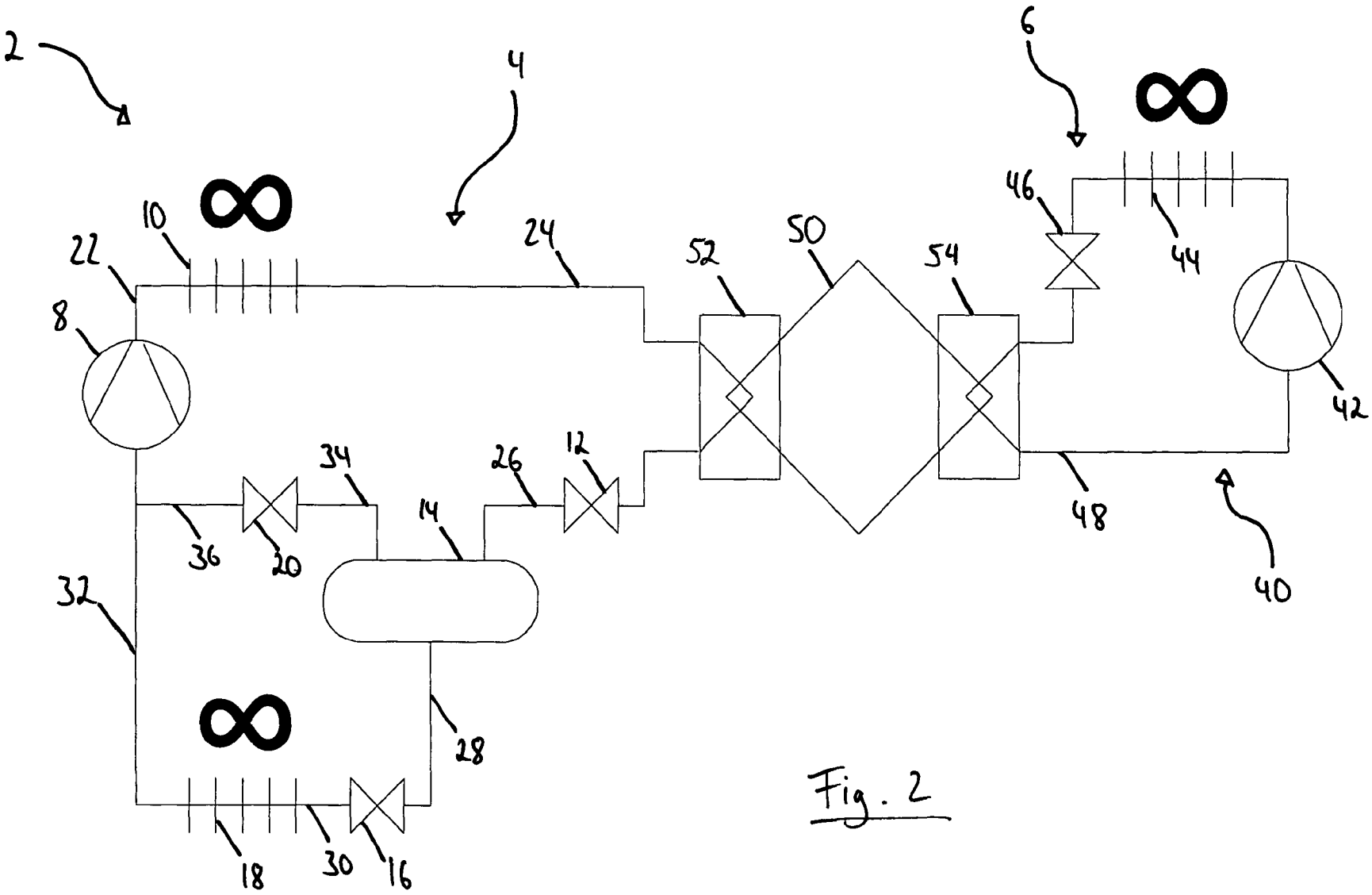
FIG. 2 shows a schematic of another exemplary refrigerating system in accordance with the present invention, wherein an intermediate heat exchange circuit is disposed between the refrigerating circuit and the desuperheating unit.

FIG. 2 shows a refrigerating system 2 in accordance with another embodiment of the present invention. The refrigerating circuit 4 and the desuperheating unit 6 have the same structure as the corresponding components of FIG. 1. Their operation is also substantially the same. Therefore, like reference numerals denote like elements.

The difference, as compared to FIG. 1, lies in the manner the heat exchange between the refrigerating circuit 4 and the desuperheating unit 6 is effected. In the embodiment of FIG. 2, it is effected via an intermediate heat exchange circuit 50. Refrigerating circuit 4 and desuperheating unit 6 are not in a direct heat exchange relationship in this embodiment.

The intermediate heat exchange circuit 50 comprises a first heat exchanger 52 and a second heat exchanger 54. The first heat exchanger 52 establishes a heat exchange relationship between the refrigerating circuit 4 and the intermediate heat exchange circuit 50. The second heat exchanger 52 establishes a heat exchange relationship between the intermediate heat exchange circuit 50 and the desuperheating unit 6. A refrigerant is flown through the intermediate heat exchange circuit 50, repetitively passing through the first heat exchanger 52 and subsequently through the second heat exchanger 54. Means maintaining the flow of the refrigerant or a secondary refrigerant, e.g. pumping means, are not shown in FIG. 2, but apparent to a person skilled in the art.

The refrigerant or the secondary refrigerant of the intermediate heat exchange circuit 50, e.g. water or brine, is cooled down in the second heat exchanger 54, transferring heat to the refrigerant of the desuperheating unit 6. In the first heat exchanger 52, on the other hand, heat is transferred from the refrigerant of refrigerating circuit 4, flowing through second refrigerant conduit 24, to the refrigerant of the intermediate heat exchange circuit 50. The heat exchangers 52 and 54 could be connected in a way to have concurrent flow, counter current flow or others. Counter current flow is normally more efficient, which could therefore be the preferred choice.

This structure allows for a more flexible placement of the refrigerating circuit 4 and the desuperheating 6, as they are decoupled in space. Still, the refrigerant of the refrigerating circuit 4 is desuperheated by the desuperheating unit 6. It is apparent to a person skilled in the art that the intermediate heat exchange circuit 50 may be replaced by any means that are capable of transferring heat from the first heat exchanger 52 to the second heat exchanger 54. The intermediate circuit 50 and the desuperheating unit 6 could also be used to cool other cold consumers with needs at an appropriate temperature level, for example air conditioning applications.

Exemplary embodiments of the invention, as described above, allow for a more efficient refrigerating system, particularly for a more efficiently operated refrigerating circuit. The desuperheating unit provides, besides the gas cooler, a second cooling means for the refrigerant in the transcritical portion of the refrigerating circuit. This allows for a more efficient cooling of the refrigerant of the refrigerating circuit. Particularly, this structure allows for compensating for the energetic disadvantages a transcritically operated refrigerating circuit has. As no condensation takes place in a transcritically operated gas cooler, the energy transfer to the environment is not as extensive. This innate disadvantage of transcritically operated refrigerating circuits is partially compensated for by the desuperheating unit, which makes it possible to operate the refrigerating system at high temperatures, without increasing pressure and temperature of the refrigerant on the pressure side of the compressor excessively. Not integrating the desuperheating unit into the refrigerating circuit has a number of advantages: the desuperheating unit can be built in an extremely compact way, irrespective of the layout of the refrigerating circuit. Also, desuperheating units with very little or no adaptations/variance can be used for a wide variety of refrigerating circuits, which allows production in a very cost-effective manner. The desuperheating unit can further use cooling techniques that do not suffer from the same disadvantages at high ambient temperatures. The compact design allows for employing efficient and cost-effective structures and, in the case of having a desuperheating refrigerant circuit, for using only a minimum amount of refrigerant. Adjusting the cooling capacity of the desuperheating unit, including switching it off, and therefore adjusting the desuperheating of the refrigerant of the refrigerating circuit, provides for another degree of freedom, when controlling the refrigerating system.

The refrigerant of the refrigerating circuit may be $CO_2$. This allows for making use of the beneficial properties of $CO_2$ as a refrigerant.

In an embodiment of the invention, the desuperheating unit may comprise a desuperheating refrigerant circuit. This allows for a high degree of flexibility in the structure representation and layout of the desuperheating unit. The desuperheating refrigerant circuit may comprise a compressor, a condenser, an expansion device, and refrigerant conduits, connecting said desuperheating refrigerant circuit elements and circulating a refrigerant therethrough. This allows for an individual design of the desuperheating refrigerant circuit parameters, for example the pressure values at the different portions of the system for the desired cooling of the refrigerant in the condenser. Still, the desuperheating unit may be formed in a very compact way and may be used irrespective of the dimensions of the refrigerating circuit.

The refrigerant of the desuperheating refrigerant circuit may be in a non-transcritical state in all parts of the desuperheating refrigerant circuit. The refrigerant of the desuperheating refrigerant circuit may leave the compressor at very high temperatures, causing an efficient heat exchange with the environment. In combination with the energy transfer through condensation of the refrigerant in the condenser, the desuperheating refrigerant circuit of the desuperheating unit can be operated in a very efficient manner. The refrigerant of the desuperheating refrigerant circuit may be one of the group consisting of Propane, Propene, Butane, R410A, R404a, R134a, NH3, DP1, and Fluid H.

It is also possible that the desuperheating unit comprises means for thermoelectric cooling, which may be easier to operate or more practical than a desuperheating refrigerant circuit in some applications.

As explained above, it is possible that the heat exchange between the second refrigerant conduit of the refrigerating circuit and the desuperheating unit is effected by a heat exchanger. The heat exchanger may constitute a close spatial proximity of the second refrigerant conduit of the refrigerating circuit and an appropriate portion of the desuperheating unit. A heat exchanger provides for an efficient heat transfer from the refrigerant of the refrigerating circuit to the desuperheating unit.

It is further possible that the refrigerating system comprises an intermediate heat exchange circuit, being in heat exchange relationship with the refrigerating circuit and the desuperheating unit. This allows for a spatial separation of the refrigerating circuit and the desuperheating unit. The desuperheating unit may therefore be positioned in an advantageous environment, for example on the roof of a building. The overall system efficiency may be improved by separating the gas cooler of the refrigerating circuit and the condenser of the desuperheating unit further. A separation of the two refrigerating circuits may be beneficial for security reasons in case of inflammable refrigerants being used. Furthermore, an intermediate heat exchange circuit, having its own degrees of freedom, for example the refrigerant being used or the flow speed of the refrigerant, provides for another means of controlling the whole refrigerating system. The intermediate heat exchange circuit may be a brine or water circuit. The intermediate heat exchange circuit may comprise a first heat exchanger for effecting heat exchange with a second refrigerant conduit of the refrigerating circuit and a second heat exchanger for effecting heat exchange with the desuperheating unit.

In a further embodiment of the invention, the intermediate pressure container of the refrigerating circuit can in operation separate liquid refrigerant from gaseous refrigerant. This allows for a more efficient cooling in the environment of the evaporator of the refrigerating circuit. The refrigerating circuit may further comprise an additional refrigerant conduit connecting the gaseous phase portion of the intermediate pressure container with the suction side of the compressor and a third expansion device arranged in the additional refrigerant conduit. In light of the present invention, this additional refrigerant conduit may be dimensioned smaller, as the increased efficiency in cooling the refrigerant in the transcritical portion of the refrigerating circuit, as effected by the desuperheating unit, causes a greater portion of the refrigerant to be in the liquid phase, when reaching the intermediate pressure container. Therefore, a smaller portion of the refrigerant is fed back through the additional refrigerant conduit.

It is furthermore possible that the pressure of the refrigerant in operation is below 120 bar in the transcritical portion of the refrigerating circuit. This allows for standard piping components to be used. Keeping the pressure below 120 bar is important for keeping system cost low, as piping, being able to sustain higher pressures, is very expensive. It is also possible that the pressure of the refrigerant in the transcritical portion is above 120 bar. Thus, the refrigerating system is enabled to work very efficiently also in the hottest regions of the world.

In a further embodiment, the desuperheating unit can selectively be switched on and off.

It is also possible to provide a plurality of fans with the gas cooler of the refrigerating circuit. The performance of the refrigerating system may be set by operating an appropriate number of fan stages and by operating the desuperheating unit, whereby achieving a desired level of desuperheating of the refrigerant in the refrigerating circuit. Seeing the plurality of fans and the desuperheating unit as a plurality of stages of cooling performance enables a finer control of the desuperheating of the refrigerant. Particularly, if the performance gain achieved by operating the desuperheating unit is smaller than the performance gain of running an additional fan stage, the minimum fractional performance may be reduced, which may result in substantial energy savings, when not a lot of desuperheating is needed under momentary system conditions. Similar considerations apply when employing a plurality of compressor stages in the refrigerating circuit.

All components in the drawings and the list of reference numerals are exemplarily shown as single components. Every component could also be a plurality of components.

With the method for refrigerating according to exemplary embodiments of the invention, as described above, the same advantages can be attained as with the refrigerating system. This method can be developed further by method steps corresponding to the features as described with regard to the refrigerating system. In order to avoid redundancy such embodiments and developments of the method for refrigerating are not repeated.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed, but that the invention will include all embodiments falling within the scope of the appended claims.

LIST OF REFERENCE NUMERALS

2 Refrigerating system
4 Refrigerating circuit
6 Desuperheating unit
8 Compressor
10 Gas cooler
12 First expansion device
14 Intermediate pressure container
16 Second expansion device
18 Evaporator
20 Third expansion device
22 First refrigerant conduit
24 Second refrigerant conduit
26 Third refrigerant conduit
28 Fourth refrigerant conduit
30 Fifth refrigerant conduit
32 Sixth refrigerant conduit
34 Seventh refrigerant conduit
36 Eighth refrigerant conduit
38 Heat exchanger
40 Desuperheating refrigerant circuit
42 Desuperheating refrigerant circuit compressor
44 Desuperheating refrigerant circuit condenser
46 Desuperheating refrigerant circuit expansion device
48 Desuperheating refrigerant circuit refrigerant conduits
50 Intermediate heat exchange circuit
52 First intermediate circuit heat exchanger
54 Second intermediate circuit heat exchanger

The invention claimed is:

1. Refrigerating system comprising a refrigerating circuit having, in flowing direction, a compressor, a gas cooler, a first expansion device, an intermediate pressure container, a second expansion device, an evaporator and refrigerant conduits circulating a refrigerant therethrough;

wherein the first expansion device expands the refrigerant to an intermediate pressure level;

wherein a first refrigerant conduit of the refrigerant conduits connects the compressor and the gas cooler, and a second refrigerant conduit of the refrigerant conduits connects the gas cooler and the first expansion device, the first refrigerant conduit, the gas cooler, and the second refrigerant conduit forming a transcritical portion of the refrigerating circuit;

wherein the compressor is operable such that the refrigerant is in a transcritical state in the transcritical portion;

wherein the refrigerating system further comprises a desuperheating unit, the desuperheating unit being in a heat exchange relationship with at least a part of the second refrigerant conduit, thereby in operation desuperheating the refrigerant being circulated in the refrigerating circuit;

wherein a plurality of fan stages is provided with the gas cooler;

wherein the performance of the refrigerating system is in part controlled by operating an appropriate number of fan stages and by operating the desuperheating unit, thereby achieving a desired level of desuperheating of the refrigerant in the refrigerating circuit.

2. Refrigerating system according to claim 1, wherein the refrigerant of the refrigerating circuit is $CO_2$.

3. Refrigerating system according to claim 1, wherein the desuperheating unit comprises a desuperheating refrigerant circuit.

4. Refrigerating system according to claim 3, wherein the desuperheating refrigerant circuit comprises a desuperheating refrigerant circuit compressor, a desuperheating refrigerant circuit condenser, a desuperheating refrigerant circuit expansion device, and desuperheating refrigerant circuit refrigerant conduits circulating a refrigerant therethrough.

5. Refrigerating system according to claim 3, wherein the refrigerant of the desuperheating refrigerant circuit is in a non-transcritical state.

6. Refrigerating system according to claim 3, wherein the refrigerant of the desuperheating refrigerant circuit is selected from the group consisting of Propane, Propene, Butane, R410A, R404a, R134a, NH3, DP1, and Fluid H.

7. Refrigerating system according to claim 1, wherein the desuperheating unit comprises means for thermoelectric cooling.

8. Refrigerating system according to claim 1, wherein the heat exchange between the second refrigerant conduit and the desuperheating unit is effected by a heat exchanger.

9. Refrigerating system according to claim 1, wherein the refrigerating system comprises an intermediate heat exchange circuit, being in heat exchange relationship with the refrigerating circuit and the desuperheating unit.

10. Refrigerating system according to claim 9, wherein the intermediate heat exchange circuit is a brine or water circuit.

11. Refrigerating system according to claim 10, wherein the intermediate heat exchange circuit comprises a first heat exchanger for effecting heat exchange with the second refrigerant conduit and a second heat exchanger for effecting heat exchange with the desuperheating unit.

12. Refrigerating system according to claim 1, wherein the intermediate pressure container of the refrigerating circuit in operation separates liquid refrigerant from gaseous refrigerant.

13. Refrigerating system according to claim 12, wherein the refrigerating circuit further comprises an additional refrigerant conduit connecting the gaseous phase portion of the intermediate pressure container with the suction side of the compressor and a third expansion device arranged in the additional refrigerant conduit.

14. Refrigerating system according to claim 1, wherein the pressure of the refrigerant in operation is below 120 bar in the transcritical portion of the refrigerating circuit.

15. Refrigerating system according to claim 1, wherein the desuperheating unit can selectively be switched on and off.

16. Method for refrigerating, comprising:

compressing a refrigerant to a transcritical pressure level;

cooling the refrigerant in a gas cooler;

desuperheating the refrigerant via heat exchange with a desuperheating unit;

expanding the refrigerant to an intermediate pressure level via a first expansion device;

flowing the refrigerant into an intermediate pressure container;

expanding the refrigerant further via a second expansion device;

flowing the refrigerant through an evaporator, thus cooling the environment of the evaporator; and controlling the performance of the refrigerating system in part by operating an appropriate number of fan stages and by operating the desuperheating unit, thereby achieving a desired level of desuperheating of the refrigerant in the refrigerating circuit.

* * * * *